United States Patent [19]

Petaja

[11] 4,279,433

[45] Jul. 21, 1981

[54] EMERGENCY LOCATOR BEACON FOR SKIS

[76] Inventor: Danny A. Petaja, P. O. Box 4519, Aspen, Colo. 81611

[21] Appl. No.: 35,030

[22] Filed: Apr. 30, 1979

[51] Int. Cl.[3] ..... A63C 7/10; A63C 11/22

[52] U.S. Cl. ..... 280/605; 116/DIG. 11; 280/819; 340/571; 340/573

[58] Field of Search ..... 280/604, 605, 809, 816, 280/819; 180/272, 273, 290; 116/84, 86, 100, DIG. 11; 340/547, 568, 571, 573, 574, 321

[56] References Cited

U.S. PATENT DOCUMENTS

| | | | |
|---|---|---|---|
| 741,036 | 10/1903 | Hemming | 116/84 |
| 1,121,496 | 12/1914 | Gustafson | 116/84 |
| 4,019,602 | 4/1977 | Habiger | 180/273 |
| 4,078,824 | 3/1978 | Riedel | 280/605 |
| 4,151,509 | 4/1979 | Winiczei | 180/273 X |

*Primary Examiner*—Joseph F. Peters, Jr.
*Assistant Examiner*—Michael Mar
*Attorney, Agent, or Firm*—Townsend and Townsend

[57] ABSTRACT

A beacon device locates ski equipment such as skis and ski poles which has been separated from a skier. The device includes a signaling device such as a strobe light mounted in or to the equipment which is activated by a trigger mechanism operative to sense the separation of the ski equipment from the skier. Various alternative trigger mechanisms are provided including optically actuated, mechanically actuated and magnetically actuated devices. A strobe light reflector is provided which always directs light upward. The beacon device is particularly useful in locating ski equipment buried in powder snow.

16 Claims, 7 Drawing Figures

EMERGENCY LOCATOR BEACON FOR SKIS

BACKGROUND OF THE INVENTION

This invention relates to a beacon signaling device for locating ski equipment which has been separated from the skier or buried in snow, and particularly it relates to a strobe signaling device.

Ski equipment, specifically skis and ski poles, is easily lost or buried in snow, especially in powder snow, whenever a skier falls and the skis or poles are released and become separated from the skier. It is particularly desirable to release skis and poles to minimize the risk of injury to the skier during a fall. A so-called safety line may be used to tie a ski to a ski boot in order to prevent the free flight of the ski. However, the safety line represents a safety hazard to the skier, since the skier can easily become tangled in the safety line during a fall and the skis can carom and collide with the tumbling skier thereby resulting in severe injury.

The need for and use of safety lines has decreased, particularly since the invention of the automatic ski brake (see for example U.S. Pat. Nos. 3,989,271 and 4,078,824). Nevertheless, a released ski or pole is subject to free flight to some degree and can easily become buried in snow. The problem is particularly acute in powder snow conditions in which the snow is characterized by a dry, light, extremely loose and low density cover which is easily penetrated by a relatively long and narrow structure such as a ski pole or ski. Consequently, ski poles and skis are particularly difficult to find a powder snow.

A device is therefore needed to aid in retrieval of ski equipment such as skis and poles in snow, particularly in powder snow, after separation from the skier.

SUMMARY OF THE INVENTION

In order to aid in the retrieval of ski equipment misplaced or buried in snow, a beacon locator is provided in the equipment which, according to the invention, is activated by separation of the skier from the equipment to emit a train of light flashes which is visible through snow. For this purpose, a strobe light is provided which is activated by a sensor which senses separation of the ski equipment and skier. As used herein ski equipment includes skis and ski poles.

In one specific embodiment, a strobe light and associated driving circuitry are mounted in a windowed enclosure sealed against moisture on the ski at a position generally adjacent the ski boot, and a trigger mechanism is provided which is operative to sense movement of the ski boot from the ski. The trigger mechanism can be incorporated into a ski brake. The strobe light can be mounted in a gravity sensitive reflector which always points generally upward.

In another specific embodiment, a strobe light and associated driving circuitry are mounted within hollow cavity of a shank and grip of a ski pole, and a trigger mechanism is provided for sensing the release of the handle grip from a hand. The trigger mechanism may include an ambient light sensor disposed in the handle grip in a position so that it is normally covered by the palm of the hand. The strobe is activated by removal of the palm of the hand from over the light sensor.

Other specific embodiments of the invention are described in the following detailed description taken in conjunction with the accompanying drawings.

BRIEF DESCRIPTION OF THE DRAWINGS

In the following detailed description, like features are referenced by the same numerals.

DETAILED DESCRIPTION OF SPECIFIC EMBODIMENTS

The problem to which this invention is addressed, namely location and recovery of ski equipment buried in snow, is solved by the use of an electrical signaling device on each piece of ski equipment, the devices being activated by separation of the equipment from the skier. The specific embodiments herein disclosed employ a strobe light as a signalling device, an unexpected discovery having been made that a strobe light discharge is visible even through snow pack and especially through powder snow. Moreover, it has been discovered that dispersion of the light discharged through the snow enhances the visibility of the beacon signal, assuming the ambient light conditions are not so substantially brighter than the strobe light discharge. Still further, in specific embodiments means are provided for assuring that the signaling light is directed upward so that the signal is not likely to be blocked by obstructions.

A strobe light driven by a train of pulses is the preferred embodiment of the electrical signaling device. The strobe light is characterized by a relatively brilliant, though short discharge or light burst. The pulse rate of the strobe light is selected to permit an accompanying discharge capacitor and battery power supply sufficient time to recharge to a voltage level sufficient to fire the strobe light after a burst. A suitable pulse rate is in the range of about one second to about fifteen seconds.

The figures depict two general types of embodiments, namely embodiments useful with a ski and embodiments useful with a ski pole. FIGS. 1, 2, 3, 5 and 7 show embodiments applicable to skis. FIG. 6 shows an embodiment applicable to ski poles, and FIG. 4 is a representative circuit for use in the devices.

Figure 1:
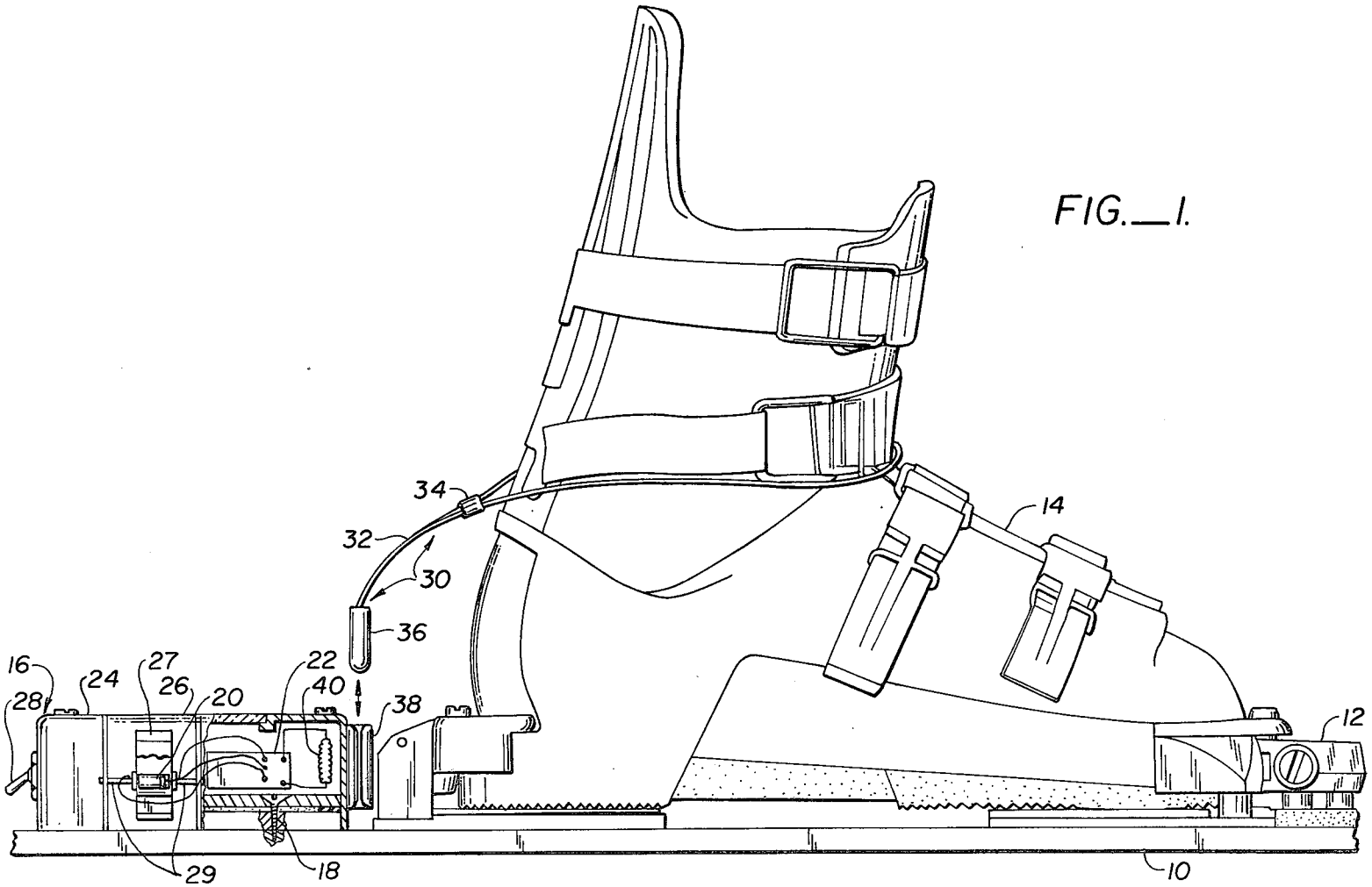
FIG. 1 is a side view in partial cross-section illustrating one embodiment of the invention mounted to a ski.

Referring first to FIG. 1, there is shown a ski 10 to which is mounted a binding 12 which holds a ski boot 14 to the ski 10. A beacon locating device 16 according to the invention is mounted on the top side of the ski 10 with for example wood screws 18. The locating device 16 comprises an electrical signaling device, and specifically a strobe light 20, a circuit 22 coupled to the strobe light 20, a housing 24 enclosing the circuit and the strobe light and mounted to the ski 10. The housing 24 includes a view window 26 preferably in the top side of the housing 24 (opposite the top of the ski 10). The strobe light 20 is located next to the window 26 in the focus of a rotatable parabolic reflector 27. The strobe light 20 is mounted between axis pins 29 of the reflector 27, the axis being longitudinally disposed relative to the ski 10. A simple on-off switch 28 is provided on the outside of the housing 24, preferably on the side thereof furthest from the ski boot 14. The on-off switch is connected to the circuit 22 to arm a triggering mechanism as hereinafter explained. The device 16 includes a triggering mechanism 30 comprising a means for sensing and signaling the movement of the ski boot 14 towards separation of the ski 10.

A number of specific triggering mechanisms are disclosed hereinafter. In FIG. 1, the triggering mechanism 30 comprises a cord 32 which is looped around the boot 14 and cinched by a noose 34. The cord 32 extends from the boot a pedetermined distance to a slug 36 bonded to the end of the cord 32. A tubular-shaped clip 38 is mounted on a side of the housing 24 and is of a size sufficient to receive and slideably hold the slug 36. The clip 38 may be a resilient member having a cross-section adapted to snugly hold the slug 36.

Within the housing 24, which may be sealed against moisture penetration, is a magnetic reed switch 40 which is mounted immediately adjacent the clip 38. The slug 36 is a magnet having sufficient magnetic field strength to activate the reed switch 40 when the slug 36 is placed in the clip 38. The placement of the slug 36 within the clip 38 is therefore defined as being within an effective proximity of the reed switch 40. The reed switch 40 is sensitive to a magnetic field to exhibit one state (either opened or closed) within the effective proximity, and the opposite state outside the effective proximity.

In operation, the slug 36 is placed in the clip 38. The strobe light 20 is inactive whenever the slug 36 is so emplaced. If, however, the boot becomes separated from the ski, as might occur in a violent fall, the line or cord 32 drawn around the boot 14 pulls the slug 36 from the clip 38, whereupon the reed switch 40 senses the removal of the magnetic field, and changes state or switches. Thereupon, the circuit 22 is activated which causes the strobe light 20 to discharge. The parabolic reflector 27 tips with the ski 10 to direct the light upward. The circuit 22 continues to cause the strobe light 20 to discharge intermittently until the device is either turned off (by switch 28 or the reinsertion of slug 36) or the power source, a battery, runs down. It is not contemplated that the locating device 16 will be required to operate more than a few minutes before located and recovered.

Figure 2:
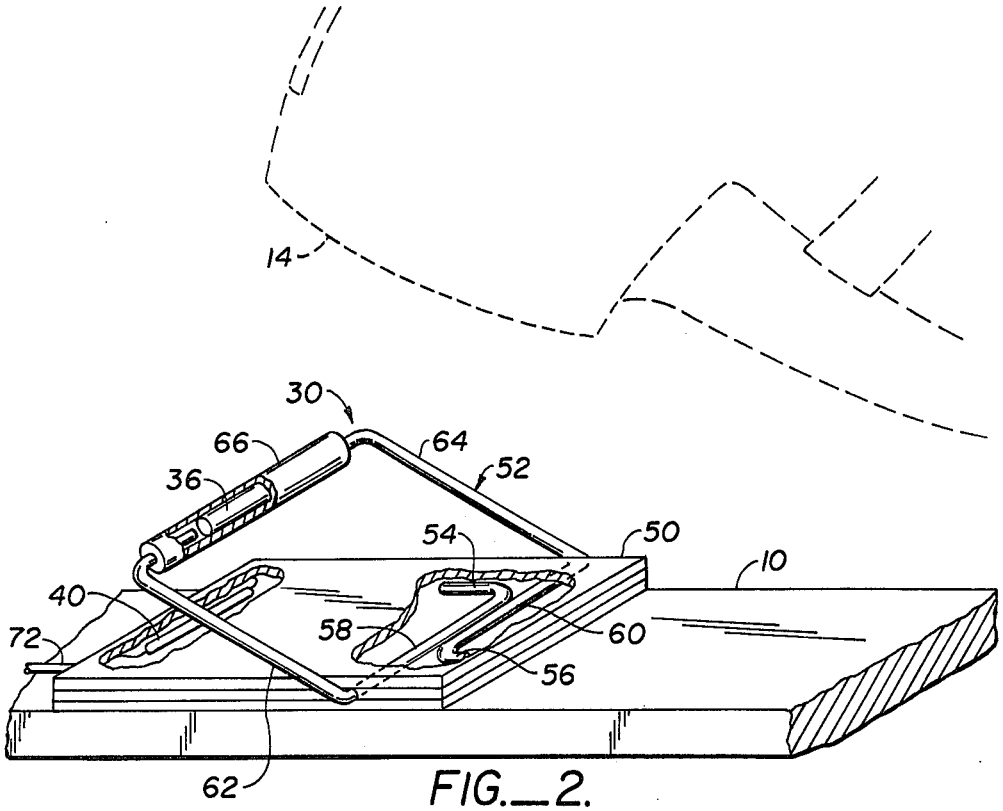
FIG. 2 is a perspective view illustrating a specific embodiment of a trigger mechanism mounted to a ski.

Turning now to FIG. 2, there is shown an alternative embodiment of the triggering mechanism 30 according to the invention. A plate 50 is mounted to a ski 10 directly under the heel portion of a boot 14 (shown in phantom). A stirrup-shaped spring clip 52 is mounted to the plate 50. The spring clip 52 comprises two rods having first and second bent ends 54, 56 embedded in the plate 50, first and second segments 58, 60 disposed transverse of the longitudinal axis of the ski within the plate 50 and generally rotatable about an axis transverse of the ski 10, and first and second side segments 62, 64 protruding from the lateral sides of plate 50 and being generally parallel to the ski 10. The side segments are joined by a bar 66 extending between the free ends of the side segments 62, 64. The spring clip 52 is biased by the ends 54, 56 toward a position with the bar 66 raised from the top of the plate 50. A ski boot 14 confronting the bar 66 presses the bar 66 against the plate 50.

Within the bar 66 is embedded a magnet 36 which is used to activate and deactivate a reed switch 40 embedded within the plate 50 at a position which is closely adjacent the bar 66 at its closest position to the plate 50. The reed switch 40 is connected through a cable 72 to device 16 (FIG. 1).

In operation, the spring clip 52 of the triggering device 30 is normally set with the bar 66 closely adjacent the reed switch 40, that is, within a magnetically effective distance, to activate the reed switch 40. Upon displacement of the boot 14 from the bar 66, as might be caused by separation of the boot 14 from the ski 10, the bar 66 is raised from the plate 50, thereby separating the reed switch 40 from the effective magnetic field of the magnet 36 causing the reed switch 40 to switch. Consequently, the device 16 (as shown in FIG. 1) can be activated.

Figure 3:
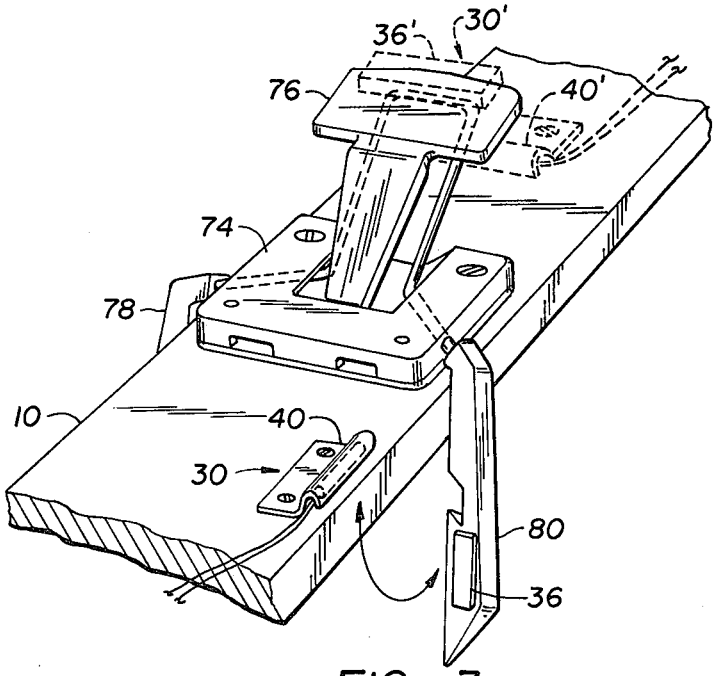
FIG. 3 is a perspective view illustrating a further specific embodiment of a trigger mechanism according to the invention incorporated in a ski brake on a ski.
Figure 4:
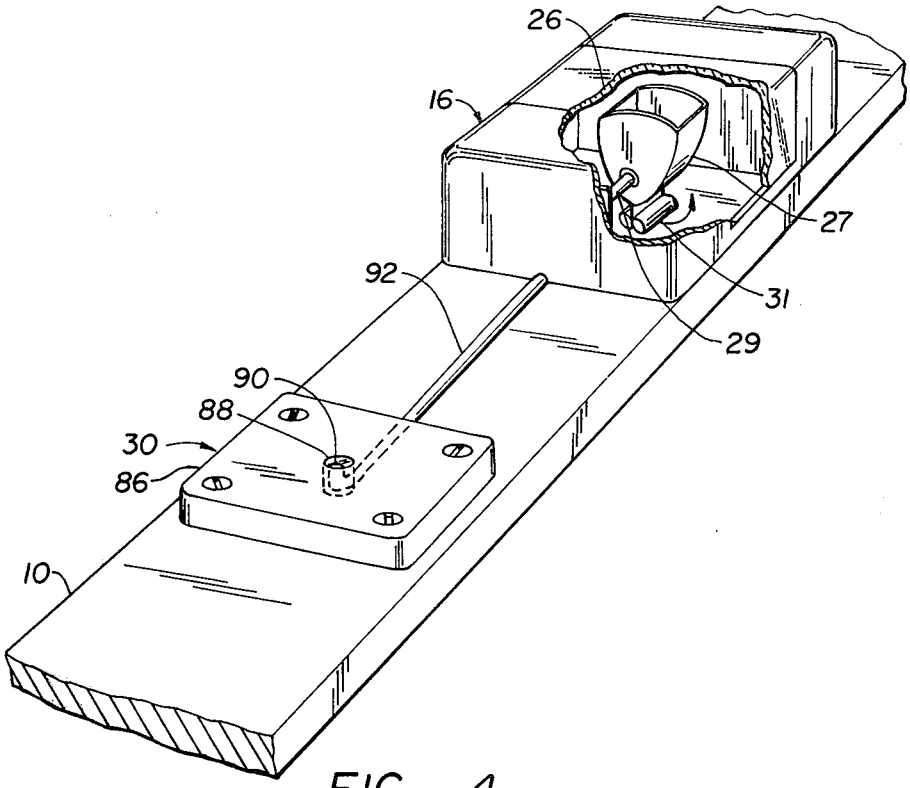
FIG. 4 is a perspective view illustrating a further specific embodiment most clearly showing a rotatable parabolic reflector.

FIG. 3 shows two further alternative embodiments of the invention. There is shown a portion of a ski 10 and a ski brake 74 having a pedal 76 and braking prongs 78, 80. The pedal 76 is normally movable between a position closely abutting to the surface of the ski 10 and a position spaced from the surface of the ski 10. The braking prongs 78, 80 are movable between a position closely adjacent the side of the ski 10 and a position approximately vertically perpendicular to the longitudinal axis of the ski 10 such that the prongs can engage underlying snow.

The displacement of the pedal 76 and ski prongs 78, 80 from the position confronting the ski, as would generally be caused by the removal of a boot (not shown) from the pedal 76, is used to advantage in a beacon locater triggering device 30 or 30'. For example, a magnet 36 can be mounted to a side of a ski prong 80. A reed switch 40 is mounted to the ski 10 adjacent the closest position of the magnet 36 to the side of the ski 10. In this position, the reed switch 40 is within an effective magnetic field of the magnet 36 when the prong 80 is adjacent the ski 10.

Alternatively, a magnet 36' may be mounted to the brake pedal 76, and a reed switch 40' may be mounted directly underneath the brake pedal 76 and thus at a position sufficiently near the magnet 36' to be within an effective magnetic field when the brake pedal 76 is depressed.

FIG. 4 illustrates a still further embodiment of a triggering device 30. In this embodiment, an optical sensor is illustrated. A mounting plate 86 is disposed under the heel position of the ski boot (not shown). The mounting plate 86 includes a hole 88 generally perpendicular to the surface of the ski 10. The hole 88 is disposed under the heel of the boot (not shown) so that the boot covers the hole and blocks light thereto. Within the hole 88 is the end 90 of a fiber optic cable 92. The fiber optic cable 92 leads to a light-sensitive triggering element (not shown) of the locater device 16. The locater device 16 is activated whenever a boot is removed from the ski 10 exposing the end 90 in hole 88 to sufficient ambient light to actuate the light-sensitive element in the device 16.

In addition, FIG. 4 illustrates in greater detail the parabolic reflector 27. The reflector 27 is parabolic through the axis of the strobe (not shown) the axis pins 29 may be placed at the focus. The reflector 27 is rectangular in cross-section in planes parallel to the axis pins 29. Weights 31 bias the reflector 27 to the desired orientation.

Figure 5:
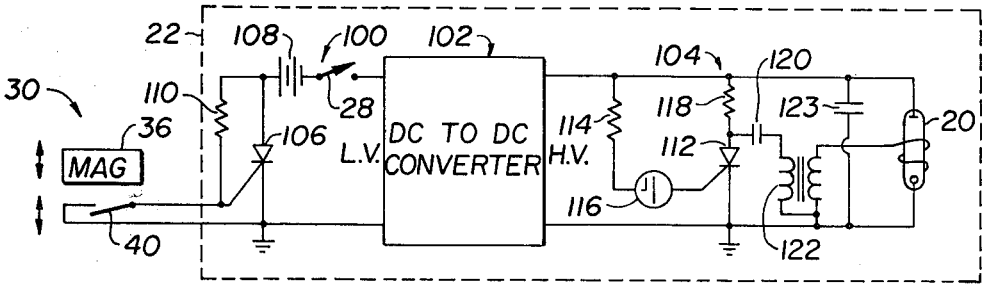
FIG. 5 is a schematic and block diagram of a representative light flashing circuit.
Figure 6:
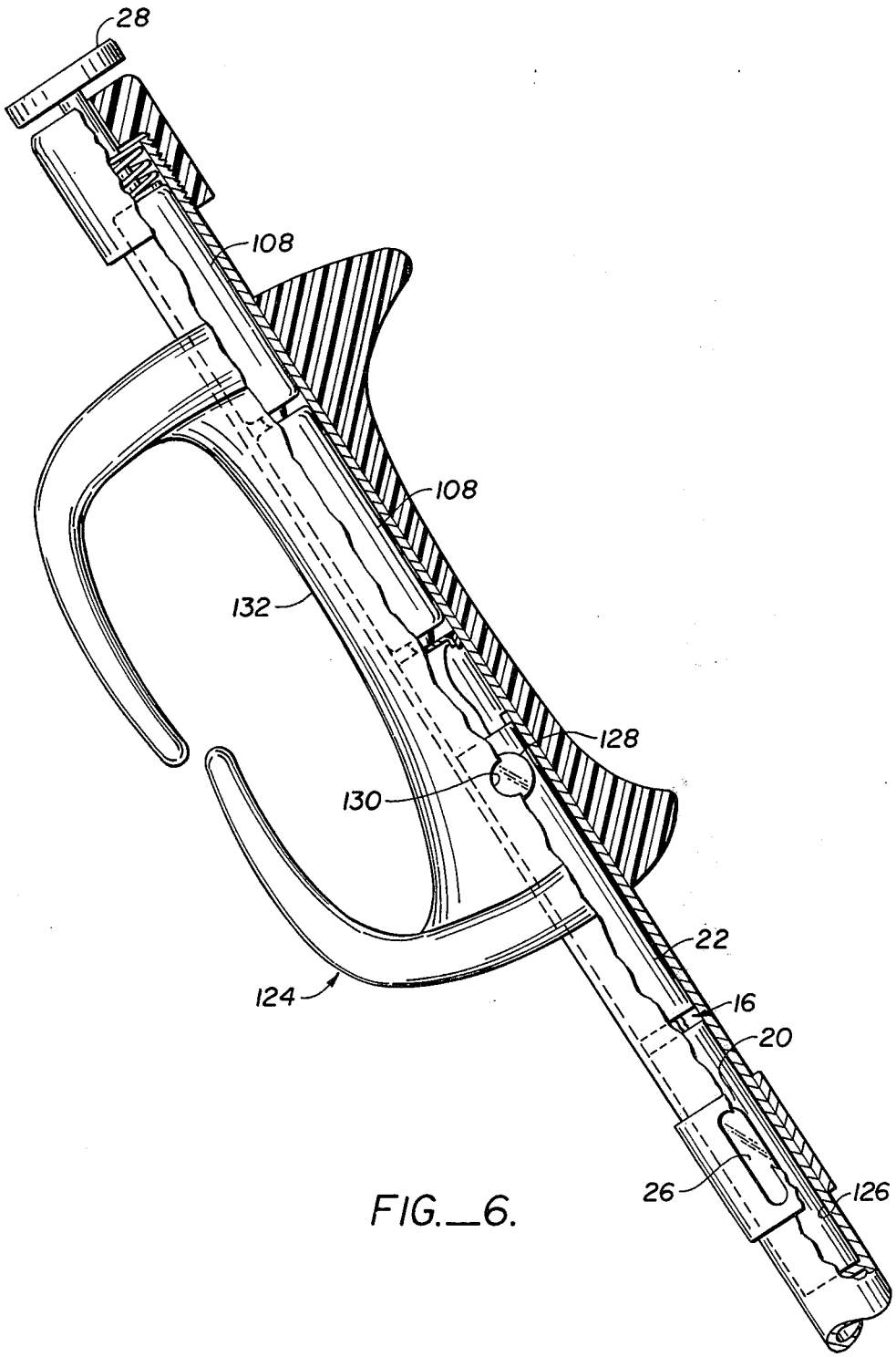
FIG. 6 is a side view in partial cross-section illustrating a ski pole incorporating the invention.

FIG. 5 represents one specific embodiment of a circuit 22 of the locater device 16. Other embodiments within the scope of this invention are suggested by circuit 22. The circuit components comprise generally conventional elements. The circuit 22 is divided into three sections, namely a trigger section 100, a voltage converter section 102, and a strobe firing section 104. The trigger section 100 includes the triggering device 30, an SCR switch 106, a battery 108 and an on-off switch 28. The triggering device 30 depicted is a magnet 36 and reed switch 40. Any of the triggering devices 30 disclosed herein could be used. The reed switch 40 is connected between the gate and cathode of SCR switch 106 and is normally closed. A resistive element 110 is connected between the gate and the anode of SCR switch 106. When the magnet 36 is removed from the vicinity of the reed switch 40, the reed switch 40 opens, allowing the gate of SCR 106 to conduct through the resistive element 110 thereby causing the SCR 106 to fire, and thus applying voltage across the input terminals of the DC to DC converter 102.

In the event a light-sensitive triggering device 30 is employed, as for example described in conjunction with FIG. 4, the resistive element 110 and reed switch 40 may be omitted, and a photo conductive or photo resistive cell can be coupled between the gate and anode of SCR 106. In its simplest embodiment, the trigger section 100 is a switch for applying voltage to the converter 102.

The DC to DC converter 102 may be a conventional solid-state inverter circuit as found in a common photographic flash strobe. The purpose of the DC to DC converter 102 is to provide a high-voltage output to the strobe firing section 104 which is sufficient to fire a common camera-type xenon photographic flash lamp. An SCR 112 is used to fire the flash lamp 20. A resistor 114 coupled in series with a neon lamp 116 is coupled in series between the high-voltage source and the gate of the SCR 112. A charging resistor 118 is coupled between the high-voltage source and the anode of SCR 112. A pulsing capacitor 120 is coupled between the anode of the SCR 112 and a primary input terminal of a pulse transformer 122. A secondary output terminal of pulse transformer 122 is coupled to the firing terminal of the flash lamp 20. A charging capacitor 123 is coupled across the anode and cathode terminals of the flash lamp 20. The strobe firing section 104 operates in a cycle to intermittently fire the flash lamp 20 whenever the charging capacitor 123 has stored sufficient charge to operate the flash lamp 20.

The device 16 is conveniently built into a ski pole. FIG. 6 depicts a portion of a ski pole 124 in partial cross-section showing the device 16 incorporated in a hollow shank 126 and within a grip 132. A battery power supply 108 comprises series connected cells coupled through a switch 28 at the top of the pole 124. The circuit 22 is mounted coaxially within the grip 132 and shank 126 of the pole 124. The circuit 22 includes a light-sensing device such as a photocell 128. A passage 130 is provided between the outer palm section of the grip 132 and the interior. The light-sensitive device 128 is disposed adjacent the passage 130 to receive ambient light therethrough when the passage 130 is uncovered. The flash lamp 20 is mounted adjacent a window 26 in the shank 126. The window 26 may be a slit in the side of the shank 126, or it may be a translucent or transparent tube substituting for a portion of the shank 126. A tube of high impact clear plastic matting between opposing portions of the shank 126 may be a suitable window.

In use, the switch 128 is set to activate the circuit 22. The palm of the hand (not shown) is placed over the passage 130 to block ambient light. In the event of a fall, where a skier drops the pole, the palm of the hand is separated from the grip 132. The light-sensing device 128 is then exposed to ambient light through the passage 130 whereupon the circuit 22 is triggered. Shortly thereafter, the flash lamp 20 begins to flash intermittently. The flash enables the pole to be located more easily, particularly if the pole becomes buried in the snow.

Figure 7:
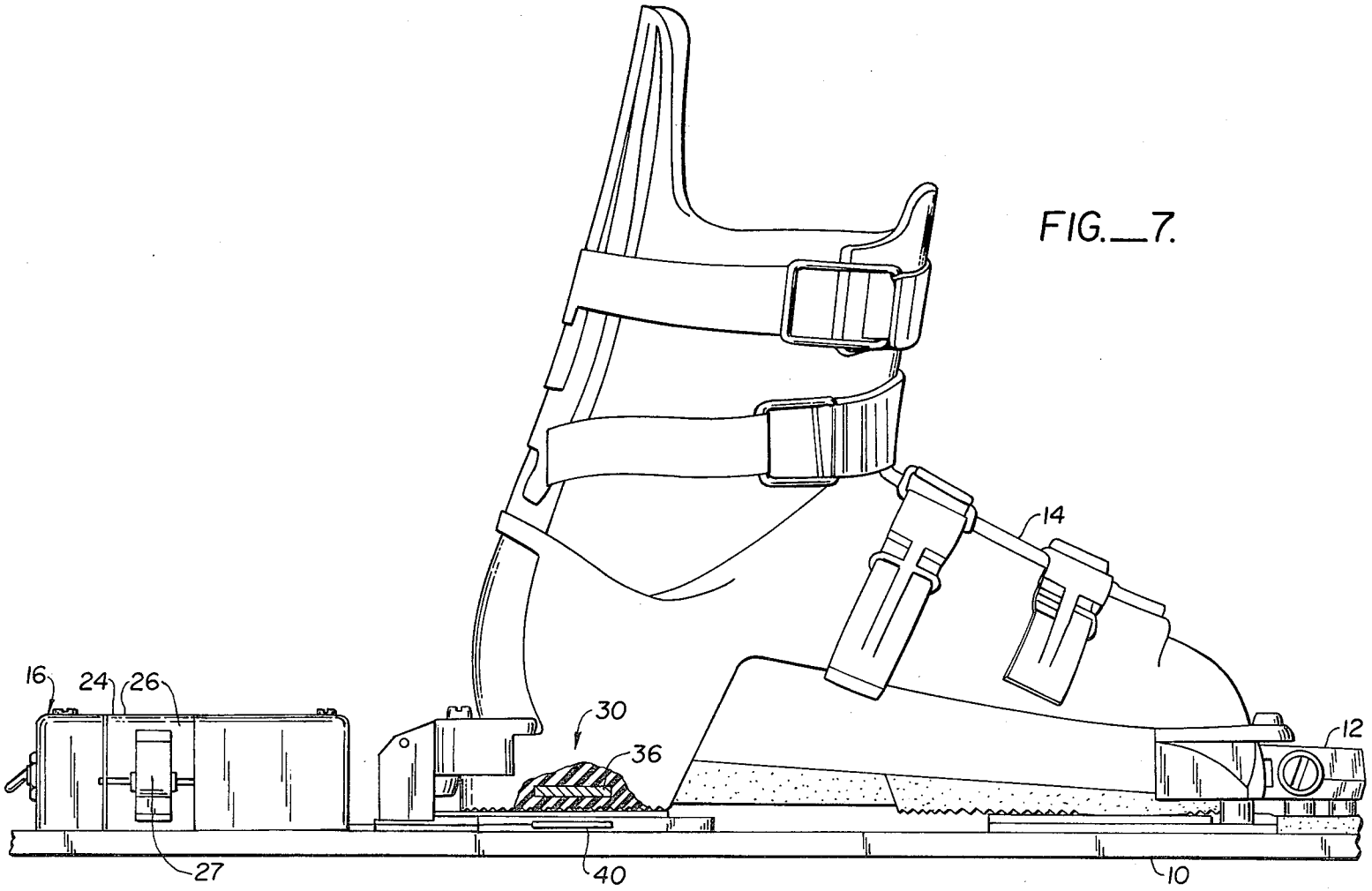
FIG. 7 is a side view in partial cross-section illustrating a still further embodiment of the invention mounted to a ski.

FIG. 7 illustrates a further embodiment of the ski beacon, similar to the embodiment of FIG. 1. The triggering device 30 on the ski 10 is incorporated into the heel of the ski boot 14 by mounting the magnet 36 in the boot 14 at a position adjacent the reed switch 40 on the ski 10.

The invention has now been explained with reference to specific embodiments. Still further embodiments will be apparent to those of ordinary skill in the art. For example, the strobe light may be mounted in a fixed reflector. It is therefore not intended that the invention be limited except as indicated by the appended claims.

What is claimed is:

1. A device for locating ski equipment separated from a skier comprising:

an electrical signaling device for emitting visible light, said signaling device having a light intensity sufficient to be visible through snow to establish location of said signaling device;

circuit means coupled to said signaling device for powering said signaling device, said circuit means being operative to intermittently discharge said signaling device upon triggering;

means for housing said signaling device and said circuit means, said housing means being adapted to be carried by said ski equipment; and means operative to sense separation of said skier from said ski equipment including said housing means for triggering said circuit means upon said separation.

2. The locating device as claimed in claim 1 wherein the ski equipment is a ski and wherein said signaling device is a strobe light and wherein said housing means includes a window adjacent said strobe light.

3. The locating device as claimed in claim 2 further including a parabolic reflector and wherein said strobe light is mounted in said parabolic reflector.

4. The locating device as claimed in claim 3 further including axis pins and wherein said reflector is mounted to said axis pins and is rotatable about said axis pins.

5. The locating device according to claim 4 further including weight means connected to said parabolic reflector in a manner biasing said reflector to direct light upward.

6. The locating device as claimed in claim 1 wherein the ski equipment is a ski having a binding with a boot detachably mountable to the binding, and wherein said housing means comprises an enclosure fixedly attached to the ski and wherein said triggering means comprises means for sensing separation of the ski from the ski boot.

7. The locating device as claimed in claim 6 wherein said separation sensing means comprises an optical sensing device and means for blocking ambient light input to the optical sensing device except when the boot is detached from the binding.

8. The locating device as claimed in claim 1 wherein the ski equipment is a ski pole having a grip and a hollow shank, wherein said housing means comprises a cavity in said shank and said signaling device is a strobe light, said device further comprising a port window adjacent said strobe light in said shank, and wherein said triggering means comprises means for sensing the separation of a skier's hand from the grip.

9. The locating device as claimed in claim 14 wherein said sensing means comprises a passage in a portion of the grip which is normally blocked by the palm of the hand and an optical sensing device coupled to said circuit means which is disposed within the grip to receive ambient light through said passage.

10. The locating device as claimed in claim 7 or claim 9 further comprising a fiber optic light transmission line coupled to said optical sensing device for directing ambient light to said optical sensing device.

11. A device for locating ski equipment separated from a skier comprising:

an electrical signaling device;

circuit means coupled to said signaling device for powering said signaling device, said circuit means being operative to intermittently discharge said signaling device upon triggering;

means for housing said signaling device and said circuit means, said housing means being adapted to be fixedly attached to a ski;

means operative to sense separation of the ski from a ski boot for triggering said circuit means upon said separation; said triggering means comprising first means adapted to contact the boot for sensing movement of the boot, a magnet in said movement sensing means, switch means coupled to said circuit means and attached to the ski for signaling the displacement of said magnet, said magnet being adapted to be disposed within an effective proximity of said magnetic sensing means only when the boot is normally attached to the ski.

12. The locating device as claimed in claim 7 wherein said boot movement sensing means comprises a line attachable to the boot, wherein said magnet is a slug, and wherein said magnetic sensing means comprises a clip adapted to slideably hold said slug, said clip being mounted to an exterior side of said housing, and a magnetically sensitive reed switch mounted on an interior side of said housing adjacent said clip such that said clip can hold said slug within said effective proximity to said reed switch.

13. The locating device as claimed in claim 7 wherein said boot movement sensing means comprises a stirrup-shaped spring wire pivotally mounted to the ski and having said magnet mounted to said wire, said wire being moveable between a first position under compression by the boot with the magnet confronting said magnetic sensing means, and a second position with the magnet separated from said magnetic sensing means, the wire being biased to said second position, and wherein said magnetic sensing means is mounted to the ski under the heel of the boot.

14. The locating device as claimed in claim 7 wherein said boot movement sensing means comprises a movable element of a ski brake.

15. The locating device as claimed in claim 7 wherein said boot movement sensing means comprises a magnet attached to said boot and a read switch attached to said ski.

16. The locating device as claimed in claim 7 wherein said boot movement sensing means comprises a ski brake having a braking element, said braking element being movable between a first disengaging position adjacent the ski and a second position and wherein said magnet is mounted to said braking element and said magnet sensing means is mounted to said ski at a location confronting said magnet when said braking element is in said first position.

* * * * *